United States Patent [19]

Lefevre et al.

[11] Patent Number: 4,803,018

[45] Date of Patent: Feb. 7, 1989

[54] SPLASH FILL FOR HEAT AND MASS TRANSFER APPARATUS AND METHOD OF MAKING A SPLASH FILL ASSEMBLY

[75] Inventors: Marcel R. Lefevre, 15990 Triple Crown Ct., Fort Myers, Fla. 33912; Marven M. Smith, II, N. Ft. Myers, Fla.

[73] Assignee: Marcel R. Lefevre, Fort Myers, Fla.

[21] Appl. No.: 74,337

[22] Filed: Jul. 16, 1987

[51] Int. Cl.[4] ..... B01F 3/04

[52] U.S. Cl. ..... 261/111

[58] Field of Search ..... 261/111

[56] References Cited

U.S. PATENT DOCUMENTS

| | | | |
|---|---|---|---|
| 2,054,315 | 9/1936 | Ebner et al. | 261/111 |
| 2,356,653 | 8/1944 | Cox | 261/111 |
| 2,971,750 | 2/1961 | Boling | 261/111 |
| 3,378,239 | 4/1968 | Engalitcheff, Jr. et al. | 261/29 |
| 3,389,895 | 6/1968 | De Flon | 261/111 |
| 3,468,521 | 9/1969 | Furlong et al. | 261/111 |
| 3,643,931 | 2/1972 | Henning et al. | 261/111 |
| 3,647,191 | 3/1972 | Fordyce | 261/111 |
| 3,879,502 | 4/1975 | Furlong et al. | 261/111 |
| 3,969,447 | 7/1976 | Glitsch et al. | 261/111 |
| 4,133,851 | 1/1979 | Ovard | 261/111 |
| 4,439,378 | 3/1984 | Ovard | 261/111 |
| 4,515,735 | 5/1985 | Phelps | 261/111 |
| 4,557,878 | 12/1985 | Fulkerson | 261/111 |
| 4,578,227 | 3/1986 | Ovard | 261/111 |
| 4,663,092 | 5/1987 | Kinney, Jr. et al. | 261/111 |

FOREIGN PATENT DOCUMENTS

| | | | |
|---|---|---|---|
| 1965230 | 7/1970 | Fed. Rep. of Germany | 261/111 |
| 717763 | 1/1932 | France | 261/111 |
| 614770 | 12/1979 | Switzerland | 261/111 |
| 1278418 | 6/1972 | United Kingdom | 261/111 |

*Primary Examiner*—Tim Miles

*Attorney, Agent, or Firm*—Pasquale A. Razzano

[57] ABSTRACT

A splash bar fill assembly for a splash-type cooling tower includes a plurality of splash bars, each of which includes a one-piece elongated member having a generally convex upper surface of restricted width and also having first and second edges having a pair of converging side surfaces depending downwardly therefrom at an acute angle with respect to the upper surface. The side surfaces of the elongated member are of a restricted depth. The invention includes a means for supporting the splash bar within the cooling tower and an arrangement of successive rows. Each supporting means having a first and second section which intersect at an apex. Adjacent splash bars in the first section are vertically offset in ascending orientation towards the apex. Adjacent splash bars in the second section are vertically offset in descending orientation from the apex. In another embodiment of the present invention, each row of the splash bars is vertically offset from those of an adjacent row to provide for optimal water disbursement.

11 Claims, 6 Drawing Sheets

SPLASH FILL FOR HEAT AND MASS TRANSFER APPARATUS AND METHOD OF MAKING A SPLASH FILL ASSEMBLY

BACKGROUND OF THE INVENTION

1. Field of the Invention

This invention relates to cooling tower and other direct contact heat and mass transfer devices fill assemblies and particularly to an improved splash-type fill bar construction for use in cooling tower installations.

Splash-type cooling towers utilizing "splash" fill media are well known in the art and have been widely used in the industry. They are generally characterized by streams of water falling on fill bars arranged in a geometrical pattern within a cavity beneath a water distributing system. The water falling by means of gravity splashes upon contact with the fill bars to form smaller droplets in a moving air stream.

In general, such cooling towers include a large housing through the side of which air is admitted and from the top of which the air is exhausted by suitable means such as exhaust fans. The water to be cooled is distributed throughout the housing from the upper surface of the housing by means such as the distributing pan. The water falls by gravity to a basin at the lower portion of the housing and is cooled during its descent by its intimate contact with air moving through the housing. During its descent, the water is broken into smaller droplets by splashing upon fill bars which are interspersed throughout the cavity defined by the interior of the housing. The splash fill bars thus break up the downward flow of water and provide surface area for commingling the water and air passing through the housing to promote cooling. As is well known, such cooling towers may be of the cross-flow type in which the air flows transversely to the descent of the water or of the counter-flow type in which the air travels in the direction opposite to the descent of the water. The improved splash bar and splash fill assembly of a cooling tower in accordance with the present invention is applicable to both counter-flow and cross-flow towers and is, in general, applicable to all types of towers in which the water is to be cooled or in which water provides the cooling medium.

More particularly, cooling towers employing splash-type fill may be characterized by the fact that streams of water fall upon fill bars arranged in a geometrical pattern wherein the water splashes upon contact and forms smaller droplets in a moving air stream. As the drops fall downwardly, some of the drops coalesce and impinge on lower splash bars, repeating the cycle. Exposure of the relatively warm drops of water to the moving air stream causes the water to cool and partially evaporate. Interrupting the fall of the individual drops by splashing on the fill bars, or sub-dividing into new drops to expose more surface area, promotes rapid cooling.

2. Description of the Prior Art

Splash-type fill bars have long been utilized in the art as an effective fill material for heat exchanging cooling towers. The earliest "splash" fill media, still in use today, merely consisted of rectangular or triangular wood slats, preferably made from redwood, upon which the water droplets cascading down from the top of the fill would hit the horizontal surface of the slats and "splash" or, in other words, divide into smaller droplets exposing a much larger surface for heat and mass transfer purposes.

The present splash bars are more commonly made from solid, extruded plastic material, sheet metal, aluminum or the like. These materials avoid the disadvantages of wooden splash bars, such as deterioration by rotting and increased possibility of fire hazard.

With the development of new synthetic materials, the cross-sectional configurations of splash fill bars used today vary considerably from application to application. Plastics, however, are not as rigid as wood and the major problem to be addressed in designing a plastic fill bar is the maximum distance it can span between adjacent supports. Four examples of splash bars having different configurations are disclosed in De Flon, U.S. Pat. No. 3,389,895 (the "V" bar); Furlong, U.S. Pat. No. 3,468,521 (the "Wedge" bar); Fordyce, U.S. Pat. No. 3,647,191 (the "M" bar); and Ovard, U.S. Pat. No. 4,133,851 (the "T" bar). All of these designs consist of relatively wide extruded plastic profiles that are perforated to conserve material and improve performance.

Indeed, it was determined very early that wide splash bars have a tendency to concentrate the water collected in heavy curtains of water instead of discrete droplets, and perforating the splash bars (with round or diamond-shaped holes) minimized this problem. This perforating operation, however, is costly and is usually made by a punching operation. As a result of perforating the splash bars, it is difficult to avoid the formation of micro-cracks at the edge of the holes. These cracks have a tendency to propagate, and ultimately small pieces of plastic will fall off and the slats will break. A major problem arises when these plastic fragments reach the heat exchangers or condensers and obstruct the heat exchanger or condenser tubes.

Another problem arises at the contact points between the plastic splash bars and their supporting wires. The vibrations due to impinging water and wind are enough to break the slats or bars at these points. The typical solution presently employed to combat this problem is the addition of "clips" to prevent direct contact of the wires to the slats. The addition of these "clips", however, is expensive and the labor needed to install them is extensive.

Fill assemblies comprising splash bars of a particular profile are chosen in accordance with the job requirements. Of course, all configurations should promote optimal cooling and uniformity of liquid disbursement. It should also be noted that manufacturers of splash bar fill material strive to obtain improved cooling performance and structural strength using less material. As an example of problems associated with various configurations, wide slats have been shown to accumulate a thick film of water on the upper surface which reduces the splashing effect of the large droplets. As a result thereof, the kinetic energy in the large droplets is partially expended by displacing the film of water already present on the upper surface. In this situation, only the remaining part of the slats, without the film of water, is used to generate small droplets. The result of a wide slat is fewer small droplets and consequently less heat transfer surface.

In addition, some of the prior art splash bars had an upper surface which was flat permitting liquid to accumulate thereon. Such a flat surface had a tendency to retain more water by capillarity. In such circumstances, the drainage of the liquid from the flat upper surface was severely limited by this configuration.

Some of the prior art splash bars also had edges of the upper surfaces which were rounded or at an obtuse angle from the adjacent side surfaces. If these edges are rounded or at an obtuse angle, the capillary forces have a tendency to prevent the formation of small droplets, and consequently, less heat transfer surface is utilized.

OBJECTS OF THE INVENTION

It is an object of the present invention to provide an improved splash-type fill assembly which is arranged to maximize water disbursement of water droplets cascading down from the top of a splash fill.

It is an additional object of the present invention to provide a splash-type fill assembly which increases the overall cooling efficiency and economy of operation of the cooling tower.

It is a further object of the present invention to provide an improved splash bar for use in a splash-type fill assembly which is simple and inexpensive to construct and easy to install in a fill assembly structure.

It is a still further object of the present invention to provide an improved splash bar which is designed to improve the drainage of the water impinging upon the slats.

It is a yet another object of the present invention to provide an improved splash bar which provides an increased heat transfer surface.

It is still a further object of the present invention to provide an improved splash bar for use in a splash-type fill assembly which reduces the resistance to the gas flow (air flow in the particular case of a cooling tower) by using small numerous slats.

It is yet another object of the present invention to provide an improved splash bar having an upper surface which is slightly convex to avoid any accumulation of liquid which would reduce the splashing effect of large water droplets impinging upon the upper surface.

It is yet still a further object of the present invention to provide an improved splash bar for use in a splash-type fill assembly which has an upper surface with sharp edges at an angle with the adjacent side surfaces less than 90° to maximize the formation of small droplets.

It is a still further object of the present invention to provide an improved splash bar with slats which are as shallow as possible to prevent the non-effected surfaces (other than the splashing surfaces) to collect droplets just formed by splashing on the adjacent slats.

Other objects and advantages of the invention become apparent from the following detail description and from the appended drawings in which like reference numerals have been used to designate like parts in the several views.

SUMMARY OF THE INVENTION

In accordance with one of the general objects of the present invention, a splash bar fill assembly for a splash-type cooling tower includes a plurality of splash bars, formed as one-piece elongated members. Each splash bar includes an elongated member having a generally convex, or sloped, upper surface having first and second edges which are at an acute angle with a pair of converging side surfaces of restricted depth depending downwardly therefrom.

In accordance with one of the general objects of the present invention, the upper surfaces of the slats are of a restricted width. The narrower the slats, the faster the water collected on each slat leaves the upper surface when the splashing effect occurs, and in turn, more heat transfer surfaceis utilized. In addition, the upper surface of the slats is convex to avoid any accumulation of liquid thereon which improves drainage of the droplets from the upper surface. The edges of the upper surface of the splash bars are also designed at an acute angle with respect to the adjacent side surfaces. The slats are also as shallow as possible to prevent their non-effective surfaces (other than the splashing surface) to collect the small droplets just formed by splashing on the adjacent slat.

The fill assembly also includes a support system for the splash bars. The support system allows the splash bars to be supported within the cooling tower in an arrangement of successive rows. In one embodiment, the supporting bracket has a generally inverted V-shaped configuration having a first and second section which intersect at an apex. The adjacent splash bars in the first section are arranged in a spaced-apart, vertically offset, ascending orientation towards the apex. The adjacent splash bars in the second section are vertically offset in a descending orientation from the apex. In a second embodiment of the support system, the splash bars of one row are vertically offset from those of an immediately adjacent row. This arrangement increases the moment of inertia of the assembly and therefore allows the splash bars to span a much larger distance. The staggering of the splash bars in adjacent rows prevents the water collected by a slat on the upper row to fall on the lower row where it would not splash because the relatively short distance of the fall is insufficient for the droplet to achieve enough velocity. Both configurations provide for optimal water disbursement. The support assemblies of the present invention serve a dual function, that is, to insure the rigidity of the assembly and act as "clips" to prevent vibrations and cracking at the points of contact with the support wire grid.

The supporting system includes a pair of side notches, which receive and retain vertical wire grids or rods therein for laterally spacing the support assemblies and for supporting a tension load, and a pair of base notches, which receive and retain horizontal wire grids or rods for supporting the support assemblies. These side and base notches cooperatively retain the associated vertical and horizontal wires and maintain the structural integrity of the splash bars within the assembly.

DETAILED DESCRIPTION OF THE PREFERRED EMBODIMENTS

Figure 1:
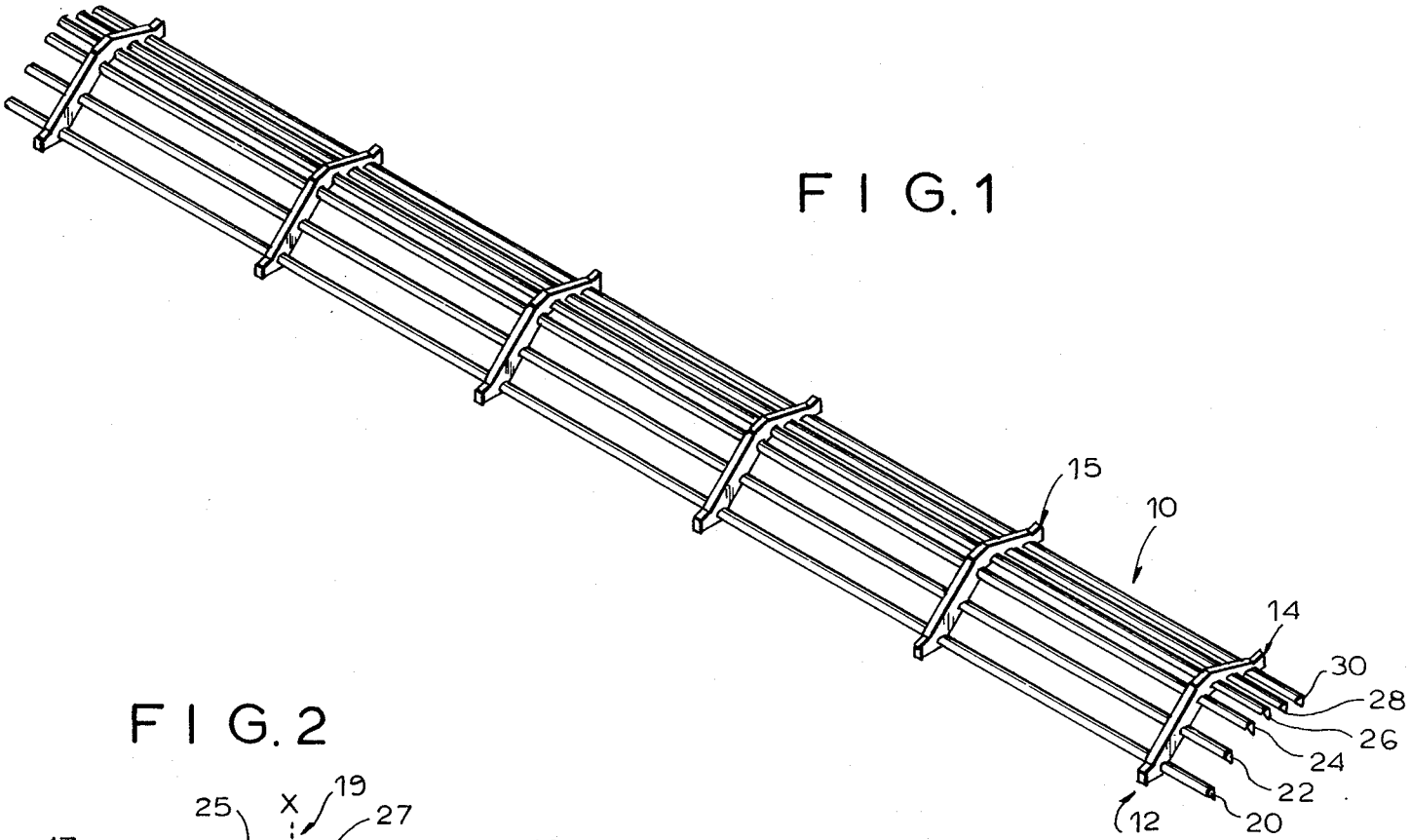
FIG. 1 is a front perspective view of one embodiment of the splash bar element and support assembly of the present invention.
Figure 2A:
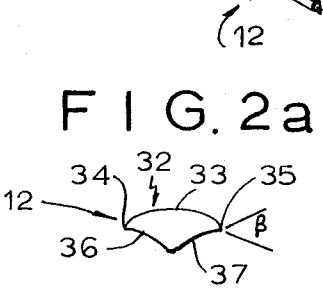
FIG. 2A is an enlarged end view of the splash bar element configuration of FIGS. 1 and 2.
Figure 2:
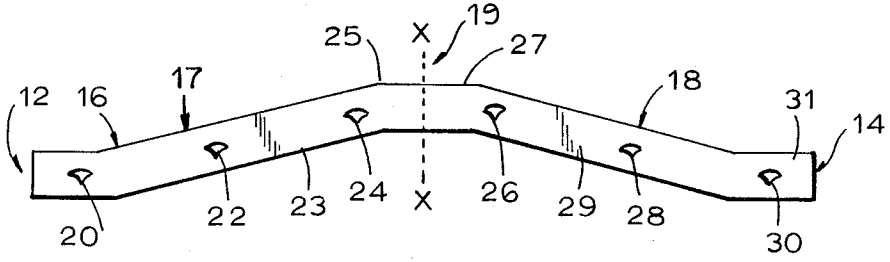
FIG. 2 is an end view of the splash bar assembly of FIG. 1.

Referring now to the drawings in detail and initially to FIGS. 1 and 2 thereof, it will be seen that a splash bar fill assembly 10 is shown for a splash-type cooling tower (not shown) wherein a plurality of splash fill bars 12 are laterally supported within the fill area of the tower by successive support assemblies, such as 14 and 15. The splash bar assembly of the present invention is quite adaptable for both cross-flow and counter-flow towers.

The configuration of the rows of splash bars 12 has been designed so that water droplets cascading down from the top of the fill will hit the slats or bars and "splash" or, in other words, divide in smaller droplets exposing a much larger surface for heat and mass transfer purposes. The configuration of the rows, such as 17 as shown in FIG. 2, provides for maximum water disbursement as the water droplets may splash on more than one splash bar within each row.

In one embodiment of the splash fill bar assembly disclosed herein, this maximum heat transfer surface is provided by each support assembly, such as 14 and 15, having a first section 16 which is generally upwardly inclined and a second section 18 which is generally downwardly inclined. The first and second sections 16 and 18, respectively, of each support assembly are separated at a mid-line or axis generally shown as line x—x in FIG. 2. A first splash fill bar 20 is received and retained within the end portion 21 of first section 16 of the support assembly. A second splash fill bar 22 is received and retained within the upwardly inclined portion 23 of first section 16. In this position, second splash bar 22 is vertically offset from first splash fill bar 20 within the same row of splash bars 17 and at a horizontal plane above the horizontal plane of splash bar 20 to provide a maximum splashing surface to the freely falling drops. A third splash bar 24 is received and retained within each support assembly at a vertically offset position from second splash bar 22 and first splash fill bar 20 and also at a horizontal plane above the horizontal plane of the first and second splash bars 20 and 22. The third splash fill bar is positioned within the top portion or apex 25 of first section 16.

Second section 18 of each support assembly is similar but not necessarily symmetrical in its configuration with respect to first section 16. A fourth splash bar 26 is received and retained within the top portion or apex 27 of second section 18 at a horizontal plane parallel to the horizontal plane of third splash bar 24 within first section 16. A fifth splash bar 28 is received and retained within the downwardly inclined portion 29 of second section 18. Fifth splash bar 28 is positioned at a horizontal plane below the horizontal plane of fourth splash fill bar 26 and at the horizontal plane of second splash bar 22 of first section 16. A sixth splash fill bar 30 is received and retained within the end portion 31 of second section 18 of each support assembly. Sixth splash fill bar 30 is on a horizontal plane parallel to the horizontal plane of first splash bar 20 in the first section 16 and is positioned at a horizontal plane below the fourth and fifth splash bars 26 and 28, respectively. This generally convex arrangement of the row of splash bars provides for optimal water distribution.

The general objective of the present invention to provide a maximum water disbursement is achieved by the configuration of each splash bar 12 within the splash bar fill assembly 10. As best shown in FIG. 2*a*, each splash bar or slat 12 includes an elongated member 32 having a generally convex upper surface 33. The upper surface of each splash bar or slat is designed to be slightly convex to avoid any accumulation of liquid on the upper surface. Accumulation of liquid on the upper surface reduces the splashing effect of each droplet impinging upon the slats as the kinetic energy contained in the droplets hitting the slats is partially expended by film present on the upper surface. A flat surface, therefore, has a tendency to retain more water by capillarity. As a result thereof, a convex upper surface, such as 33, improves the drainage of liquid from the upper surface.

The upper surface 33 of the slats must also be of a restricted width, preferably less than 12 mm but not smaller than 3 mm. The less wide the slats, the faster the waters droplets impinging upon the upper surface of the slats leaves the upper surface so that a more pronounced splashing effect occurs. Wide slats accumulate a thick film of water on the upper surface thereby reducing the splashing effect of each water droplet impinging thereupon. Slats sized within this tolerance also prevent the small droplets being generated by splashing to be collected by the adjacent slats located at the same level or by the slat itself, as frequently occurs with wide slats. In addition, the resistance to the gas flow (air flow in the particular case of the cooling tower) is reduced by using restricted width numerous slats as compared to wide slats. This is especially critical in the counter-current mode of the cooling tower.

The upper surface 33 of each elongated member 32 includes first and second edges 34 and 35, having a pair of converging side surfaces 36 and 37 which depend downwardly therefrom at an acute angle with respect to the upper surface. In this configuration, the large droplets, usually 4–6 mm in diameter, always hit relatively close to the edge of each slat. If the edges are rounded or at an obtuse angle with the side surfaces, the capillary forces have a tendency to prevent the formation of small droplets. A sharp edge at each corner of the slats therefore optimizes maximum water disbursement. Side surfaces 36 and 37 are also of a restricted depth to prevent the non-effective surfaces of each slat or splash bar 12 (other than upper surface 33) to collect the small droplets just formed by splashing on the adjacent slats.

Figure 3:
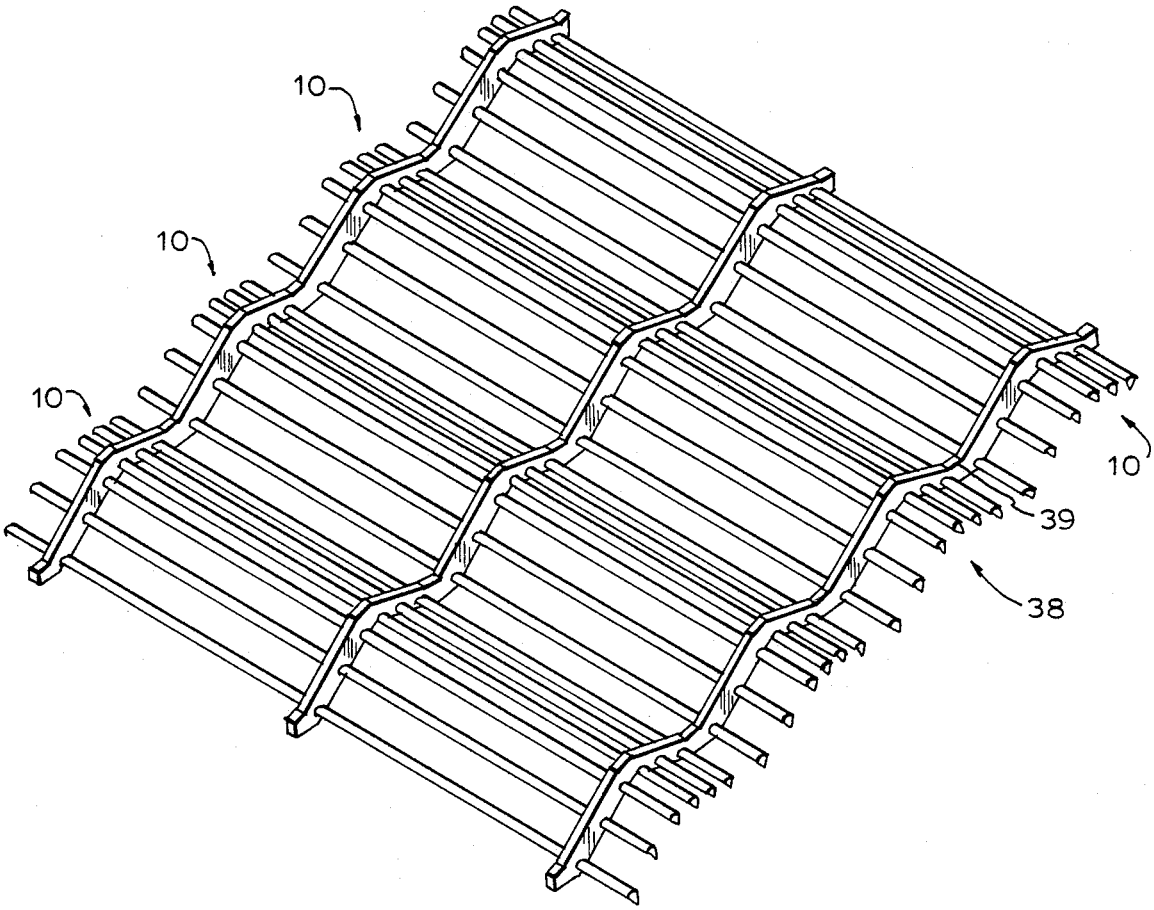
FIG. 3 is a perspective view of the successive splash bar assemblies of FIG. 1 being interconnected relative to one another, or manufactured as a single piece.

As best shown in FIG. 3, the splash bar fill assemblies 10 of FIG. 1 may be sequentially arranged to provide for continuous rows of the splash bar fill assemblies within the cooling tower to provide for a continuous single layer panel within the cooling tower. These splash bar fill assemblies can then be at varying horizontal planes within the cooling tower to provide for maximum water disbursal at various levels within the cooling tower. An adjacent splash bar fill assembly, such as 38, can be welded or fixed or preferably molded as a unitary body in any manner known to one conversant in the art at the contact point 39 of each end portion of the support assemblies 10.

Figure 4:
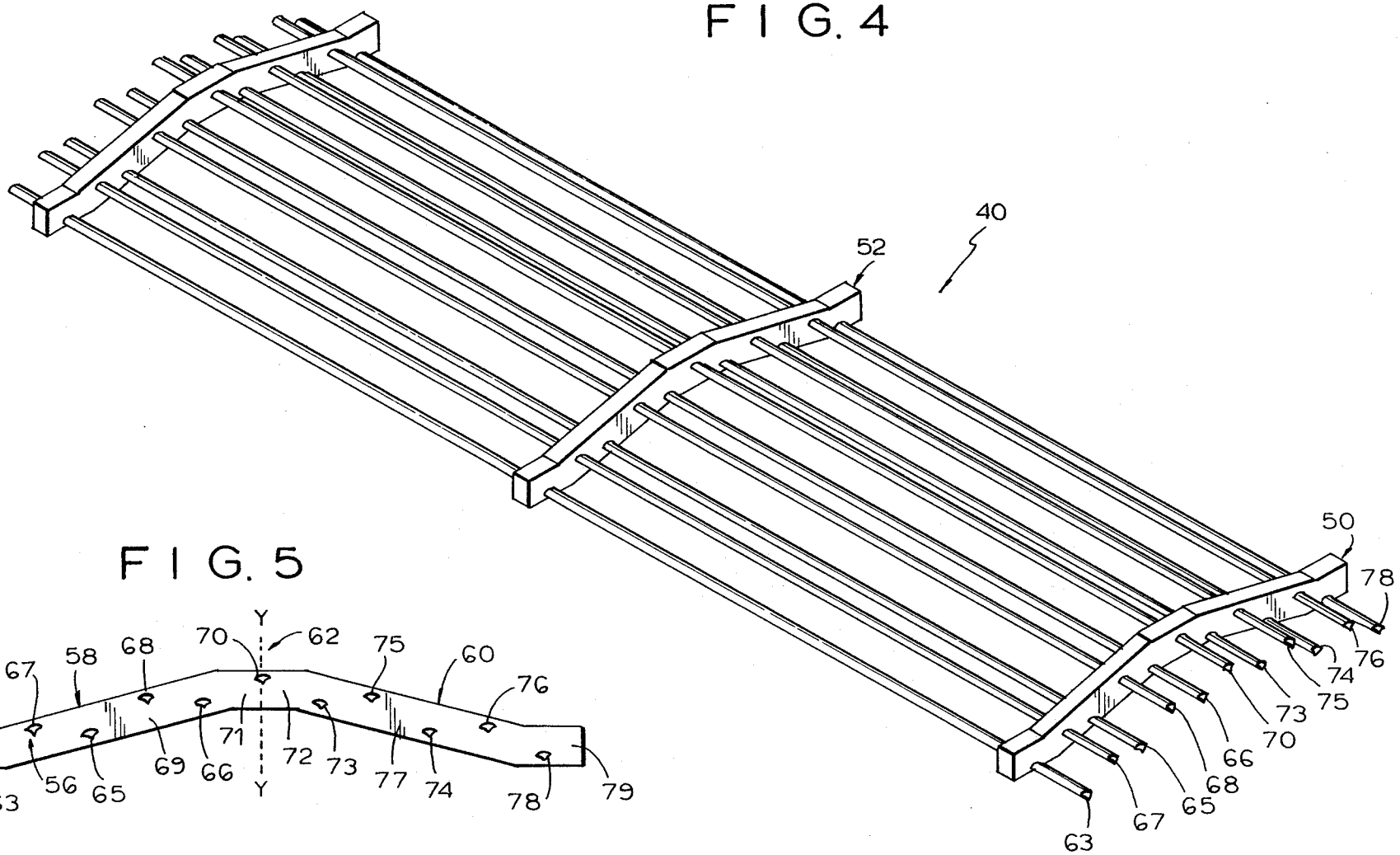
FIG. 4 is a front perspective view of another embodiment of the splash bar element and support assembly of the present invention.

A second embodiment of the splash bar fill assembly of the present invention is depicted in FIG. 4. FIG. 4 shows a different arrangement with two rows or layers of the slats arranged in an angular configuration with the apex pointing up. The two rows of slats are arranged in a V-shaped configuration to increase the moment of inertia of the assembly, thus allowing it to span a much larger distance than each individual profile or slat could span on its own. The slats or splash bars are staggered in the horizontal direction in order to prevent the water collected by a slat on its upper layer to fall on the lower layer of another slat where it would not splash because the distance of the fall of the droplet is insufficient for the droplet to reach a suitable velocity.

Figure 5:
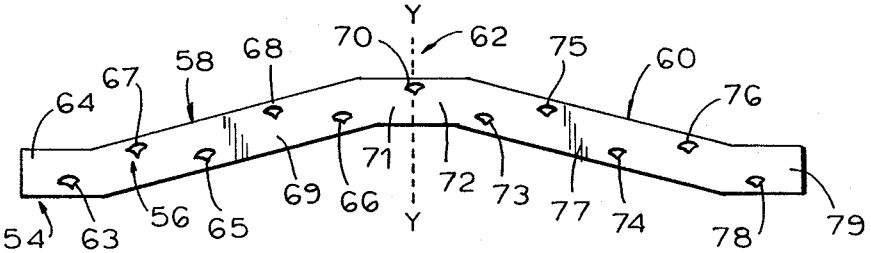
FIG. 5 is an end elevational view of the splash bar element support assembly of FIG. 4.

Specifically, FIG. 4 illustrates a splash bar fill assembly 40 having parallel support assemblies such as 50 and 52. The support assemblies receive and retain therebetween a first and second row or layer 54 and 56, respectively, of splash bars with the second row 56 being vertically offset and staggered from the first row 54. Each support assembly includes a generally upwardly inclined first section 58 and a generally downwardly inclined second section 60. The first and sections 58 and 60, respectively, are separated by an axis or mid-line generally shown as line y—y in FIG. 5. A first splash bar 63 of first row 54 is received and retained within an end portion 64 of first section 58. A second and third splash bar 65 and 66 of first row 54 are received and retained within the upwardly inclined portion of first section 69 at ascending horizontal planes from the horizontal plane of first splash bar 63. The upwardly inclined portion 69 of first section 58 also receives and retains the first and second splash bars 67 and 68 of second row 56. First and second splash bars 67 and 68 are vertically offset and staggered from the first and second splash bars 63 and 65 of first row 54. A third splash bar 70 of second row 56 is received and retained between the support assemblies at the apex or top surfaces 71 and 72 of the first and second sections, respectively. As aforedescribed, the third splash bar 70 of second row 56 is vertically offset and staggered from the third splash bar 66 of first row 54 and is vertically offset from the first and second splash bar 67 and 68 of second row 56.

The splash bars of the second section 60 are arranged symmetrically with respect to the splash bars of first section 58. The fourth and fifth splash bars 73 and 74 of first row 54 and the fourth and fifth splash bars 75 and 76 of second row 56 are received and retained by the downwardly inclined portion 77 of second section 60. Splash bars 75 and 76 are vertically staggered and offset from splash bars 73 and 74 of first row 56. The fourth splash bars 73 and 75 are at a horizontal plane above the horizontal plane of the fifth splash bar 74 and 75 of the respective rows. A sixth splash bar 78 of first row 54 is received and retained within the end portion 79 of the second section 60 at a horizontal plane below the horizontal plane of fourth and fifth splash bar 73 and 74 and parallel to the first splash bar 63 of the first row.

In the second embodiment, the two-layer or row arrangement of the V-shaped configuration of the splash bars allows the splash bar fill assembly to span much larger distances and provides a maximum splashing surface for the freely falling drops. The two-layer embodiment is a preferred embodiment as it increases the moment of inertia of the assembly, thus allowing the assembly to span much larger distances.

Figure 6:
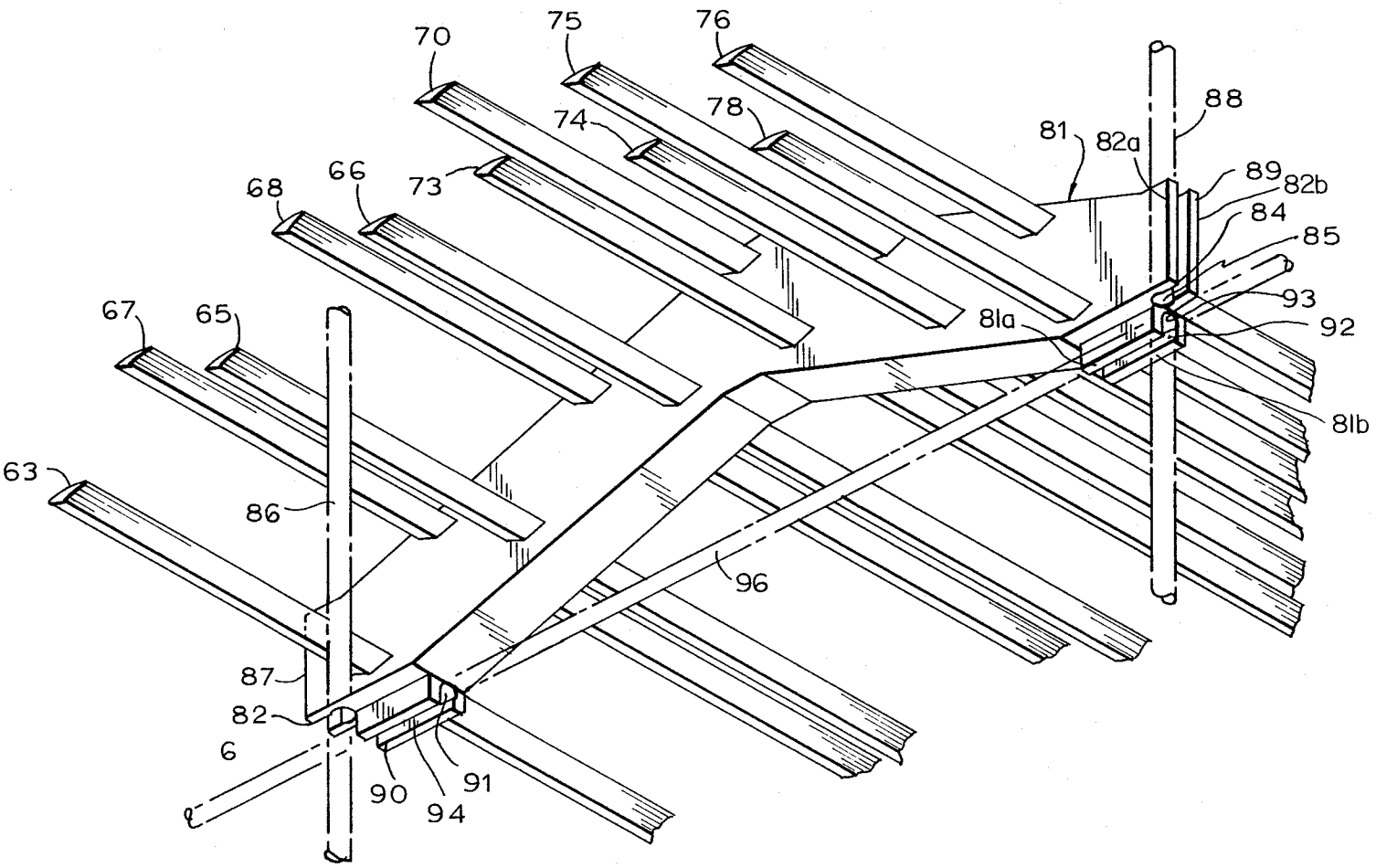
FIG. 6 is a bottom perspective view of the splash bar element and support assembly of FIG. 4 specifically illustrating the side notches and base notches of the support assembly receiving and retaining vertical and horizontal wire grids or rods, respectively.

As shown in both preferred embodiments (FIGS. 1 and 4), the slats or splash bars are rigidly connected together at regular intervals within adjacent support assemblies and perform a dual function; namely, they insure the rigidity of the assembly and act as "clips" to prevent vibrations and cracking at the points of contact with the support wire grids. The mounting of each splash fill assembly to the support wire grids or connecting rods is best shown in FIG. 6. Each support assembly, such as 81, is provided with a pair of vertical notches 82 and 84 formed in the side surfaces 83 and 85 of the support assembly. Each vertical notch includes a pair of outwardly extending arms, such as **82*a* and 82*b*. Each notch 82 and 84 receives and retains a vertical support wire grids or connecting rod, such as 86 and 88, between the arms within keyhole slots 87 and 89 formed within the vertical notches 82 and 84**, respectively, which snap-fit the vertical wire grids.

The base 90 of each support assembly, such as 81, includes a pair of base notches 91 and 93 with keyhole slots 92 and 94 formed therein. Each base notch includes a pair of outwardly extending arms, such as **81*a* and 81*b*. The arms of the base notches receive and retain a horizontal wire grid or connecting rod 96 therebetween within the keyhole slots. The horizontal rods 96 will support laterally adjacent splash fill bar assemblies such as the configuration shown in FIG. 3. The vertical wire grids or rods, such as 86 and 88**, support at varying horizontal planes the vertically spaced splash fill bar assembly. Thus, the design of this splash bar assembly supports the splash bars within the splash bar fill assembly for optimal maximum water disbursement. As a result of this construction, the support assemblies and base and side notches can be formed unitarily by injection molding.

Figure 7A:
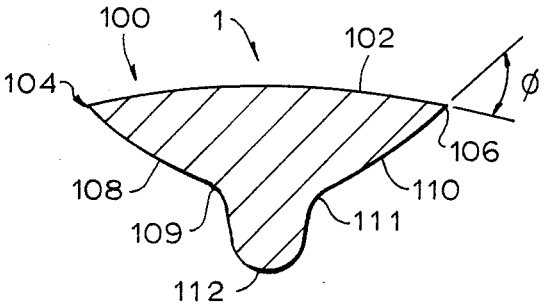
FIGS. 7*a–j* are end views of alternative splash bar element configurations constructed in accordance with the present invention.

Alternative configurations of the splash bars of the present invention are shown in FIGS. 7*a–j*. In FIG. 7*a*, the splash bar shown therein includes an elongated member having a generally convex upper surface 102 of restricted width. First and second edges 104 and 106 of the upper surface 102 are at an acute angle, generally denoted by $\phi$ to the pair of converging side surfaces 108 and 110. Each side surface 108 and 110 has a lower free end 109 and 111, respectively, which include a bulbous formation 112 formed therebetween.

Figure 7B:
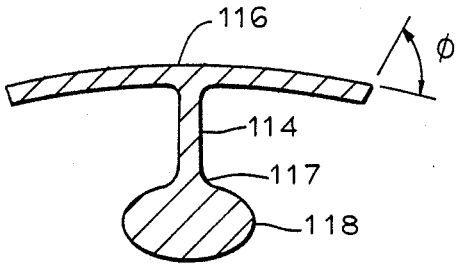
Figure 7C:
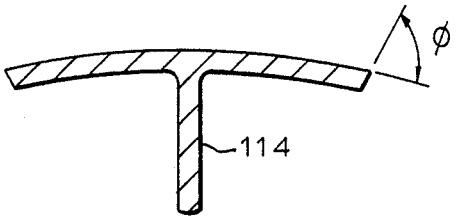
Figure 7D:
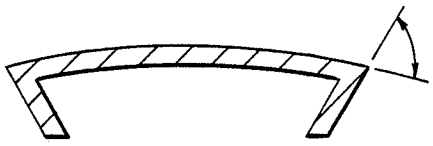

In FIG. 7*b*, a splash bar is shown having a vertical supporting rib member 114 extending downwardly from the crown 116 and a bulbous formation 118 is formed at the lower free end 117 of the vertical rib member 114. FIG. 7*c* discloses the splash bar configuration of FIG. 7*b* without the bulbous formation 118. FIG. 7*d* discloses a splash bar having converging side surfaces which are orientated at an acute angle from the upper surface of the elongated member.

Figure 7E:
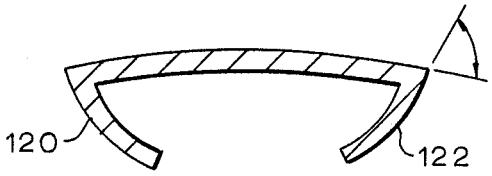
Figure 7F:
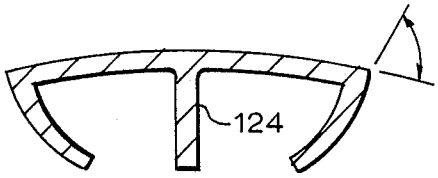
Figure 7G:
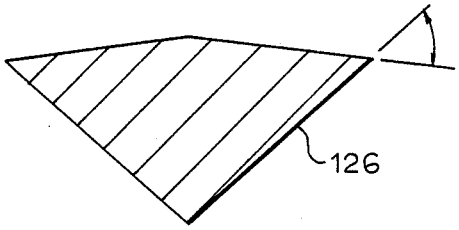
Figure 7H:
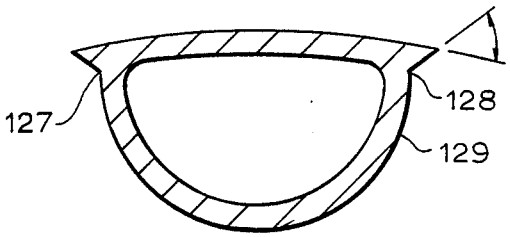
Figure 7I:
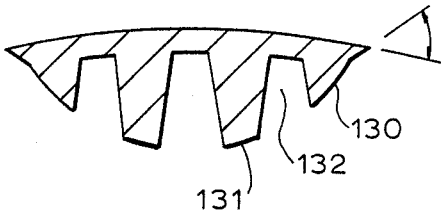

In FIG. 7*e*, the side surfaces 120 and 122 are generally convex. FIG. 7*f* discloses the splash bar of FIG. 7*e* with the addition of a vertical supporting rib member 124. The splash bar may also have a triangularly-shaped elongated member, such as the member 126 shown in FIG. 7*g*. As shown in FIG. 7*h*, a semi-circular rib member 129 extends between and is connected to the lower free ends 127 and 128 of the side surfaces of the elongated member. FIG. 7*i* discloses a splash fill bar having an elongation member including a plurality of spaced apart rib members, such as 130 and 131 forming a channel 132 therebetween.

Figure 7J:
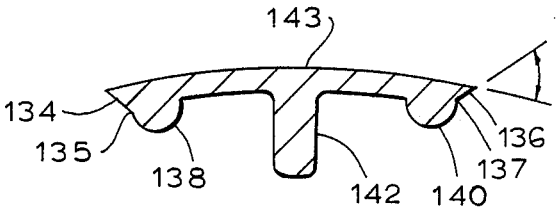

A final embodiment of a configuration of the splash bar of the present invention is shown in FIG. 7*j*. The lower free ends 135 and 136 of side surfaces 134 and 136, respectively, include bulbous formations 138 and 140 extending therefrom. A vertical rib member extends downwardly 142 from the crown 143 of the elongated member.

The splash bar constructed in accordance with the present invention optimizes the water cooling capability of the splash fill assembly. The result of the configurations of the splash bars disclosed herein provides for a maximum heat transfer surface and avoids any accumulation of liquid on the upper surface which would reduce the splashing effects of the droplets hitting the slats. In addition, the embodiments of the supporting system for the splash bar disclosed herein provides a dual function, that is, to insure the rigidity of the assembly and act as "clips" to prevent vibrations and cracking at the points of contact with the support wire grids or rods.

Although illustrative embodiments of the present invention have been described herein with reference to the accompanying drawings, it is to be understood that the invention is not limited to those precise embodiments, and that various other changes and modifications made be effected therein by one skilled in the art without departing from the scope or spirit of the invention, which is defined by the following claims.

What is claimed is:

1. A splash bar fill assembly for a splash-type cooling tower comprising at least two spaced-apart, vertically oriented, support assemblies laterlaly supporting a plurality of splash fill bars within the fill area of the tower, the splash fill bars comprising an elongated member having a generally convex upper surface of restricted width including first and second edges, the first and second edges having a pair of converging side surfaces which depend downwardly therefrom at an acute angle with respect to the upper surface, the side surfaces being of restricted depth; a crown formed at the uppermost point of the elongated member; and a vertical supporting rib member extending downwardly from the crown of the elongated member and having a lower free end which includes a bulbous formation formed thereon.

2. The improved splash fill bar of claim 1 wherein the width of the upper surface is greater than or equal to about 3 mm. but less than about 12 mm.

3. A splash fill assembly for a splash type cooling tower, which comprises:

a plurality of splash bars, each splash bar including an elongated member having a generally convex upper surface of restricted width and also having first and second edges, the first and second edges having a pair of converging side surfaces depending downwardly therefrom at an acute angle with respect to the upper surface, the side surfaces being of restricted depth; and means for supporting the splash bars within the cooling tower in an arrangement of successive rows, each supporting means having a first and second section which intersect at an apex, adjacent splash bars in the first section being received and retained vertically offset in ascending orientation towards the apex, adjacent splash bars in the second section being received and retained vertically offset in descending orientation from the apex.

4. The splash fill assembly of claim 3 wherein the supporting means includes first retention means which receive and retain vertical wires therein for laterally spacing the support assemblies and for supporting a tension load, and a second retention means which receive and retain a horizontal wire for supporting the support assemblies.

5. The splash fill assembly of claim 3 wherein the first retention means includes a pair of spaced-apart arms having a keyhole lock formed therebetween which cooperatively receives and retains by a snap fit the vertial wires.

6. The splash fill assembly of claim 3 wherein the second retention means includes a pair of spaced-apart arms having a keyhole lock formed therebetween which cooperatively receives and retains by a snap fit the horizontal wires.

7. The splash fill assembly of claim 3 wherein each row of splash bars is vertically offset from those of an adjacent row.

8. A method for manufacturing a splash bar fill assembly for a splash-type cooling tower comprising injection molding unitarily a means for supporting the splash bars within the cooling tower in an arrangement of successive rows, a pair of side notches which receive vertical wires therein for laterally spacing the support assemblies and for supporting a tension load and each including a pair of spaced-apart arms having a keyhole lock formed therebetween which cooperatively receives and retains therebetween the vertical wires, and a pair of base notches which receive and retain a horizontal wire for supporting the support assemblies and each including a pair of spaced-apart arms having a keyhole lock formed therebetween which cooperatively receives and retains by a snap fit the horizontal wires.

9. A splash bar fill assembly for a splash-type cooling tower comprising at least two spaced-apart, vertically oriented, supported assemblies laterally supporting a plurality of splash fill bars within the fill area of the tower, the splash fill bars comprising an elongated member having a generally convex upper surface of restricted width including first and second edges, the first and second edges having a pair of converging side surfaces which depend downwardly therefrom at an acute angle with respect to the upper surface, the side surfaces being of restricted depth; a crown formed at the uppermost point of the elongated member each converging side surface having a lower free end which includes a bulbous formation formed thereon.

10. A splash bar fill assembly for a splash-type cooling tower comprising at least two spaced-apart, vertically oriented, support assembly laterally supporting a plurality of splash fill bars within the fill area of the tower, the splash fill bars comprising an elongated member having a generally convex upper surface of restricted width including first and second edges, the first and second edges having a pair of converging side surfaces which depend downwardly therefrom at an acute angle with respect to the upper surface, the side surfaces being of restricted depth; a crown formed at the uppermost point of the elongated member, each converging side surface having a lower free end and a generally semi-circular rib member which is formed between each lower free end of the converging side surfaces.

11. A splash bar fill assembly for a spash-type cooling tower comprising at least two spaced-apart, vertically oriented, support assemblies laterally supporting a plurality of splash fill bars within the fill area of the tower, the spalsh fill bars comprising an elongated member having a generally convex upp®r surface of restricted with including first and second edges, the first and second edges having a pair of converging side surfaces which depend downwardly therefrom at an acute angle with respect to the upper surface, the side surfaces being of restricted depth; a crown formed at the uppermost point of the elongated member, and further including a plurality of spaced-apart rib members which extend downwardly from the elongated member forming channels therebetween.

* * * * *